US007037219B2

(12) United States Patent
Pakieser

(10) Patent No.: US 7,037,219 B2
(45) Date of Patent: May 2, 2006

(54) SOCCER TRAINING DEVICE

(76) Inventor: Greg Pakieser, 1118 Wheatland Dr., Shorewood, IL (US) 60431

( * ) Notice: Subject to any disclaimer, the term of this patent is extended or adjusted under 35 U.S.C. 154(b) by 195 days.

(21) Appl. No.: 10/647,573

(22) Filed: Aug. 26, 2003

(65) Prior Publication Data

US 2005/0049089 A1 Mar. 3, 2005

(51) Int. Cl.
*A63B 69/00* (2006.01)

(52) U.S. Cl. ..... 473/446; 473/422

(58) Field of Classification Search ..... 476/446, 476/415, 456, 422; D21/705; 473/446
See application file for complete search history.

(56) References Cited

U.S. PATENT DOCUMENTS 3,887,181 A * 6/1975 Samaras ..... 473/446
4,921,257 A * 5/1990 Heller ..... 473/446
D309,486 S * 7/1990 Guenette et al. ..... D21/705
6,264,572 B1 * 7/2001 Matheson et al. ..... 473/446
D449,084 S * 10/2001 Walters ..... D21/705

* cited by examiner

*Primary Examiner*—Eugene Kim
*Assistant Examiner*—M. Chambers
(74) *Attorney, Agent, or Firm*—Ernest Kettelson

(57) ABSTRACT

A soccer training device that comprises a net which covers the large central portion of a soccer goal but leaves limited openings in the upper corners of the goal as well as along each opposite side of the goal which are relatively harder for a goal tender to block. The objective is to train and teach soccer players to kick or otherwise lawfully propel the soccer ball through those relatively harder portions of the goal for a goal tender to block, thereby increasing the likelihood of being able to score.

1 Claim, 1 Drawing Sheet

SOCCER TRAINING DEVICE

FIELD OF THE INVENTION

This invention relates to the field of training devices for sporting activities, and in particular to the sport of soccer. It comprises a training net that is secured to a soccer goal post frame to cover the large central portion of the goal post frame which the goalie can most easily block, but leaves open the upper right and left corner portions as well as vertical portions inward a short distance from the respective right and left upright portions of the frame. The objective is to train soccer players to drive the ball into those open areas, which are the most difficult for the goalie to block.

BACKGROUND OF THE INVENTION

Prior art known to the inventor include the devices disclosed and described in the following United States patents which are readily available to the public and others having an interest therein:

| | |
|---|---|
| 6,264,572 | 3,856,298 |
| 5,902,194 | 3,840,228 |
| 5,503,402 | 2,256,555 |
| 4,948,147 | D413,949 |
| 4,921,257 | D309,486 |
| 3,944,223 | |

While the general objective of the prior art training devices is similar, the training device in accordance with the present invention has a number of improvements and advantages over the prior art, including the fact that it comprises an already put together unitary net that can be attached to the soccer goal framework in one piece that does not require attaching separate pieces to the goal framework or to the training net itself. It comprises almost entirely a soft, flexible cord construction that can be easily folded and compressed into a small compact unit for storage and for carrying without breaking or damaging any component part. A soft, flexible training device is less likely to cause injury than prior art devices having hard, solid component parts. Since the training net in accordance with this invention is an already put together, fully assembled, unitary structure, there are no separate parts to be lost or misplaced as is the case with prior art sports training devices.

DESCRIPTION OF PREFERRED EMBODIMENT

Figure 1:
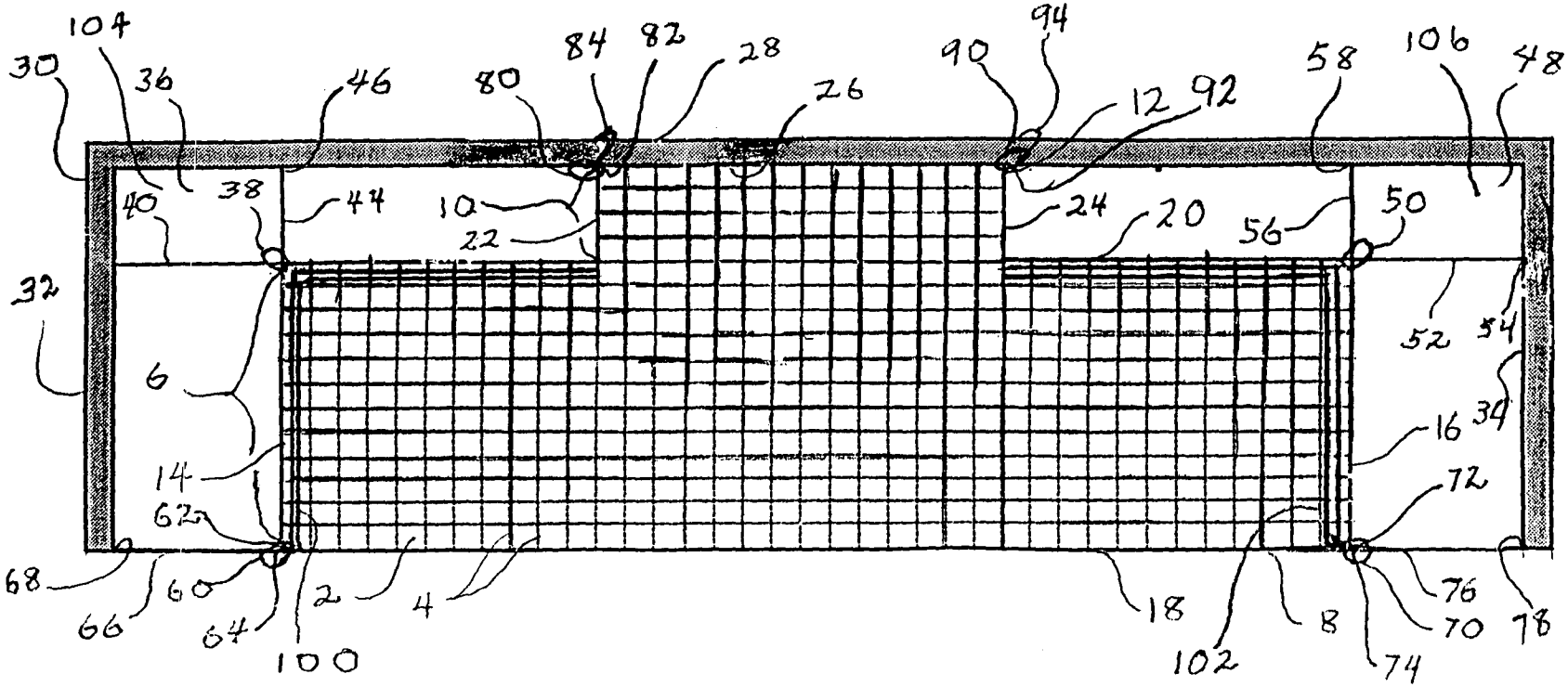
FIG. 1 is a front elevation view of the entrance to a soccer goal framework with a training net in accordance with this invention shown in place thereon.

The training net for soccer in accordance with the present invention comprises a unitary net 2 made of cords 4 interconnected to form five inch by five-inch squares. The cords 4 which make up the five by five squares in the preferred embodiment are three-eighths-inch poly rope as known in the trade. Poly rope is made of synthetic fibers known as polypropylene. It is also within the scope of the invention to use cords made of natural fibers such as cotton, as well as synthetic materials other than polypropylene. The preferred embodiment uses polypropylene fibers, which are less subject to shrinking or stretching and other changes when exposed to rain, snow, ice and temperature extremes, and other weather conditions.

The unitary training net 2 comprises a relatively large rectangular portion 6 at the lower end 8 interconnected with a smaller rectangular portion 10 centered at the upper end 12. The large rectangular portion 6 extends from a first side edge 14 a distance of sixteen feet to the opposite second side edge 16 along and between a bottom edge 18 and an upper edge 20. The smaller rectangular portion 10 is centered on the upper edge 20 of the large rectangular portion 6, having an upwardly extending first side edge 22 spaced apart inwardly from the first side edge 14 of the large rectangular portion 6 a distance of three feet, and an upwardly extending second side edge 24 spaced apart inwardly from the second side edge 16 of the large rectangular portion 6 a distance of three feet. The small rectangular portion 10 extends for a distance of ten feet between its first side edge 22 to its second side edge 24.

The side edges 14 and 16 of the large rectangular portion 6 extend upwardly a distance of six feet. The side edges 22 and 24 of the smaller rectangular portion 10 extend upwardly a distance of two feet. The overall height of this preferred embodiment of the unitary training net 2 from the bottom edge 18 of the large rectangular portion 6 to the upper edge 26 of the small rectangular portion 10 is eight feet.

The upper edge 26 of the small rectangular portion 10 is secured to the upper cross-bar 28 of a soccer goal framework 30, at which time the bottom edge 18 of the large rectangular portion 6 of the training net 2 reaches the ground. The training net 2 is positioned on the upper cross-bar 28 of the goal framework 30 at the point where the first side edge 14 of the large rectangular portion 6 is spaced apart inwardly three feet from the first upright leg 32 of the goal framework 30 and where the second side edge 16 of the large rectangular portion 6 is spaced apart inwardly three feet from the second upright leg 34 of the goal framework 30. At such time the first side edge 22 of the small rectangular portion 10 is spaced apart inwardly six feet from the first upright leg 32 of the goal framework 30, and the second side edge 24 of the small rectangular portion 10 is spaced apart inwardly six feet from the second upright leg 34 of the goal framework 30.

At the corner 36 where upper edge 20 of the large rectangular portion 6 intersects the first side edge 14 thereof, a connecting loop member 38 is provided to connect laterally extending support rope 40 which extends to the first upright leg 32 of the soccer goal framework 30 to which it is secured by tying the outer end 42 of the rope 40 there around. An upwardly extending support rope 44 is also connected at one end to the connecting loop member 38, and that support rope 44 extends upwardly to the cross-bar 28 of the soccer goal framework 30 to which the outer end 46 of the rope 44 is secured by tying around the cross-bar 28.

At the corner 48 where upper edge 20 of the large rectangular portion 6 intersects the second side edge 16 thereof, a connecting loop member 50 is provided to connect one end of the laterally extending support rope 52 which extends to the second upright leg 34 of the soccer goal framework 30 to which the outer end 54 of rope 52 is secured by tying around the upright leg 34. An upwardly extending support rope 56 is also connected at one end to the connecting loop member 50, and such rope 56 extends upwardly to the cross-bar 28 of the soccer goal framework 30 to which the outer end 58 of the rope 56 is secured by tying around the cross-bar 28.

A loop-connecting member 60 is secured to the corner 62 of the large rectangular portion 6 at which the bottom edge 18 intersects the lower end of the first side edge 14. The first end 64 of a laterally extending support rope 66 is connected to the loop connecting member 60, and the support rope 66 extends laterally to the first upright leg 32 of the soccer goal framework 30 to which the outer end 68 of the rope 66 is secured by tying there around.

Another loop connecting member 70 is secured to the corner 72 of the large rectangular portion 6 at which the bottom edge 18 intersects the lower end of the second side edge 16. The first end 74 of a laterally extending support rope 76 is connected to the loop connecting member 70, and the support rope 76 extends laterally to the second upright leg 34 of the soccer goal framework 30 to which the outer end 78 of the rope 76 is secured by tying there around.

Another loop connecting member 80 is secured to the corner 82 of the small rectangular portion 10 at which the upper edge 26 thereof intersects the upper end of the first side edge 22. A tie portion of a rope 84 extends through the loop-connecting member 80 and around the cross-bar 28 of the soccer goal framework 30.

Another loop connecting member 90 is secured to the corner 92 of the small rectangular portion 10 at which the upper edge 26 thereof intersects the upper end of the second side edge 24. A tie portion of a rope 94 extends through the loop-connecting member 90 and around the cross-bar 28 of the soccer goal framework 30.

The upper edge 26 of the small rectangular portion 10 is thus held adjacent to and parallel to the cross-bar 28 of the soccer goal framework 30.

A first doubled back cord 100 extends upwardly along and inwardly of the first side edge 14 of the large rectangular portion 6 and then laterally along and inwardly of the upper edge 20 of the large rectangular portion 6 to terminate at the first side edge 22 of the small rectangular portion 10.

A second doubled back cord 102 extends upwardly along and inwardly of the second side edge 16 of the large rectangular portion 6 and then laterally along and inwardly of the upper edge 20 of the large rectangular portion 6 to terminate at the second side edge 24 of the small rectangular portion 10. The double back cords 100 and 102 reinforce and stabilize the respective edges of the unitary training net 2 along which they extend.

When the training net 2 is in place on the soccer goal framework 30 as described, it blocks the large central portion of the goal that is most easily defended by the goal tender or goalie, but it provides openings of about three feet in width and about eight feet in height along each opposite side of the goal along and inward of the first and second upright legs 32 and 34, and openings about six feet wide and two feet high in each of the opposite upper corners 104 and 106 of the goal. The objective is to train soccer players to kick or otherwise lawfully propel the soccer ball through those relatively smaller openings along each opposite side and in each opposite upper corner, which are relatively more difficult for a player acting as the goal tender to block.

I claim:

1. A training device for soccer and a soccer goal post framework, said goal post framework having a first side leg extending upwardly, a second side leg extending upwardly spaced apart laterally from said first side leg, and an upper cross-bar extending laterally between said first and second side legs, an entrance opening between said first and second side legs of said goal post framework, said training device comprising a blocking member having a relatively large lower portion and a relatively smaller upper portion, said relatively large lower portion of said blocking member having an upwardly extending first side edge spaced apart inwardly from said first side leg of said goal post framework, an upwardly extending second side edge spaced apart in the direction toward said second side leg of said goal post framework, said second side edge being also spaced apart inwardly from said second side leg of said goal post framework, said blocking member having an upper edge extending laterally, said relatively large lower portion of said blocking member extending downwardly from said upper edge to terminate along a laterally extending bottom edge which is adjacent to and substantially parallel to the ground between said first and second side edges of said relatively large lower portion of said blocking member, said relatively smaller upper portion of said blocking member extending upwardly from said upper edge of said relatively larger lower portion of said extending upwardly from said upper edge of said relatively larger lower portion of said blocking member to terminate at an upper laterally extending edge of said relatively smaller upper portion of said blocking member which extends adjacent to and substantially parallel to said cross-bar of said goal post framework, said relatively smaller upper portion of said blocking member having a first upwardly extending side edge spaced apart inwardly from said first side leg of said goal post framework and located inwardly from said first side edge of said relatively larger lower portion of said blocking member, said relatively smaller upper portion of said blocking member also having a second upwardly extending side edge spaced apart inwardly from said second side leg of said goal post framework and located inwardly from said second side edge of said relatively larger lower portion of said blocking member, wherein said blocking member comprises a net, wherein said side edges of said relatively larger lower portion of said blocking member net are each spaced apart inwardly from their respective first and second side legs of said goal post framework a distance of substantially three feet, including a first doubled-back cord inwardly of and closely adjacent to said first side edge of said relatively larger lower portion of said blocking member net, said first doubled-back cord also extending laterally inwardly of and closely adjacent to a portion of said upper edge of said blocking member net, and a second doubled-back cord inwardly of and closely adjacent to said second side edge of said relatively larger lower portion of said blocking member net, said second doubled-back cord also extending laterally inwardly of and closely adjacent to a portion of said upper edge of said blocking member net.

* * * * *